US006993860B2

(12) United States Patent
Bettiol

(10) Patent No.: US 6,993,860 B2
(45) **Date of Patent: *Feb. 7, 2006**

(54) TONGUE REINFORCEMENT FOR A BOOT, A REINFORCED TONGUE AND A BOOT PROVIDED WITH SUCH TONGUE

(75) Inventor: Silvano Bettiol, Volpago Del Montello (IT)

(73) Assignee: Salomon S.A., Metz-Tessy (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/964,645

(22) Filed: Oct. 15, 2004

(65) Prior Publication Data

US 2005/0044748 A1 Mar. 3, 2005

Related U.S. Application Data

(63) Continuation of application No. 10/188,966, filed on Jul. 5, 2002, now Pat. No. 6,839,985.

(30) Foreign Application Priority Data

Jul. 20, 2001 (FR) ..... 01.09960

(51) Int. Cl.
*A43B 5/04* (2006.01)
*A43B 23/26* (2006.01)

(52) U.S. Cl. ..... 36/54; 36/88; 36/118.6; 36/119.1

(58) Field of Classification Search ..... 36/54, 36/88, 99, 72 R, 118.5, 118.6, 119.1
See application file for complete search history.

(56) References Cited

U.S. PATENT DOCUMENTS

| | | | | |
|---|---|---|---|---|
| 2,615,261 | A | 10/1952 | Grotto | 36/72 R |
| 4,534,122 | A | 8/1985 | MacPhail | 36/88 |
| 4,551,932 | A | 11/1985 | Schoch | 36/117.1 |
| 5,050,319 | A | 9/1991 | Perotto | 36/117 |
| 5,331,752 | A | 7/1994 | Johnson et al. | 36/115 |
| 5,355,596 | A | 10/1994 | Sussmann | 36/50.1 |
| 5,444,926 | A | 8/1995 | Allen et al. | 36/93 |
| 5,575,090 | A | 11/1996 | Condini | 36/54 |
| 5,647,146 | A | 7/1997 | Gabrielli et al. | 36/54 |
| 6,161,313 | A | 12/2000 | Bisson | 36/72 R |
| 6,360,454 | B1 | 3/2002 | Dachgruber et al. | 36/54 |
| 6,839,985 | B2 * | 1/2005 | Bettiol | 36/54 |

FOREIGN PATENT DOCUMENTS

| | | |
|---|---|---|
| EP | 0646335 | 4/1995 |
| EP | 0695515 | 2/1996 |
| WO | WO 00/33692 | 6/2000 |
| WO | WO 01/49142 | 7/2001 |

* cited by examiner

*Primary Examiner*—M. D. Patterson
(74) *Attorney, Agent, or Firm*—Greenblum & Bernstein, P.L.C.

(57) ABSTRACT

A boot provided with a tongue, the tongue having a lower portion and an upper portion joined by an intermediary portion. The tongue has a main flexible panel to which a semi-rigid reinforcement is affixed, the reinforcement having an elongated body that extends substantially along a longitudinal median line and over the length of the panel, the reinforcement having at least one lateral extension, each extension originating from the elongated body in the area of the lower and/or upper portion, and extending at least partially up to the area of the intermediary portion.

45 Claims, 3 Drawing Sheets

TONGUE REINFORCEMENT FOR A BOOT, A REINFORCED TONGUE AND A BOOT PROVIDED WITH SUCH TONGUE

CROSS-REFERENCE TO RELATED APPLICATIONS

This application is a continuation of U.S. patent application Ser. No. 10/188,966, filed on Jul. 5, 2002 now U.S. Pat. No. 6,839,985, the disclosure of which is hereby incorporated by reference thereto in its entirety, and the priority of which is hereby claimed under 35 U.S.C. §120.

This application is based upon French Patent Application No. 01 09960, filed Jul. 20, 2001, the disclosure of which is hereby incorporated by reference thereto in its entirety, and the priority of which is hereby claimed under 35 U.S.C. §119.

BACKGROUND OF THE INVENTION

1. Field of the Invention

The invention is directed to a tongue adapted to cover the instep and a portion of the user's lower leg in a boot with a high upper, particularly for a boot of the flexible type. The invention is also directed to the boot provided with the tongue, a reinforced tongue in particular. The invention is more specifically directed to a tongue, and a boot incorporating such tongue, adapted to practicing a sport.

Such a boot can be used in a field such as snowboarding, skiing, water skiing, snowshoeing, roller skating, ice skating, skateboarding, mountain climbing, walking, or the like.

2. Description of Background and Relevant Information

Traditionally, in the field of snowboarding, a flexible boot includes a sole and a high upper. The upper has an opening, extended by a longitudinal opening, or slit, to ease the passage of a user's foot. Here, a flexible upper designates an upper made from materials that are not completely rigid, and that allow a certain bending of the leg.

The longitudinal opening extends between a lateral quarter and a medial quarter of the boot. The longitudinal opening allows a relative spacing of the quarters from one another. A tongue blocks the longitudinal opening at least partially when the quarters are brought close together.

Because the tongue is flexible, the upper portion of the upper can bend easily, particularly toward the front. This allows the user to bend the lower leg easily toward the front.

It has been proposed to reinforce the tongue by means of a reinforcement that extends substantially over the length of a flexible panel of the tongue in order to limit the forward bending of the upper and of the lower leg. Towards that end, the reinforcement is made of a semi-rigid or rigid frame having at least one bending zone. An abutment limits the bending value of the reinforcement and, consequently, of the upper.

In the reinforcement, before the action of the abutment, only the bending zone becomes deformed. Thus, the tongue adapts itself to the deforming of the upper.

As soon as the abutment acts, the entire reinforcement opposes a forward bending of the upper. A much more substantial bending force is then required in order to continue the bending of the upper.

The reinforcement avoids or substantially reduces the risk of excessive forward bending of the lower leg. Thus, certain shocks are avoided or are less serious. The reinforcement also gives the user a support that allows a better transmission of sensory information.

Nevertheless, it has been noted that it is difficult to anticipate the action of the abutment. The activation of the latter is relatively abrupt, which oftentimes hinders the steering of the board.

SUMMARY OF THE INVENTION

In particular, the invention has an object of making progressive the passage of the tongue, and of the boot provided with the tongue, from a flexible state to a more rigid state.

For the purpose of achieving this object, the invention proposes a boot having a sole and a high upper, the upper having an upper opening extended forwardly by a longitudinal opening, a tongue blocking the longitudinal opening, the tongue having a lower portion and an upper portion corresponding to the instep and to the lower leg, respectively, of a user wearing a boot provided with the tongue, the lower and upper portions being connected by an intermediate portion.

The tongue of the boot has a main flexible panel to which a semi-rigid reinforcement is affixed, the reinforcement having an elongated body that extends substantially along a longitudinal median line and over the length of the panel, the reinforcement having at least one extension, each extension originating from the elongated body in the area of the lower and/or upper portion, and extending at least partially up to the area of the intermediate portion.

The invention also relates to the tongue and to the reinforcement. By taking support on the lateral and medial quarters of the upper, the lateral and medial extensions of the reinforcement make the tongue conform substantially to the shape of the upper. As a result, the tongue remains concave in a transverse plane, in the area of the intermediate portion, on the side of its inner surface.

This concave shape of the intermediate portion directly influences the bending rigidity of the tongue.

Without a tightening of the upper, the extensions can distance themselves, which consequently allows the forward bending of the tongue and of the upper.

When the upper is tightened, the extensions are transversely maintained, which slightly tensions the panel. The latter remains in tension when the lower leg tends to bend forwardly, with the tension being proportionate to the bending force.

This is the reason why the passage from a flexible state to a more rigid state of the tongue is progressive. The rigidity is proportionate to the bending force and correlates to the tightening of the upper.

Since the user perceives the progressive variation of the rigidity of the tongue, he can advantageously anticipate the level of maximum rigidity. As a result, he is not taken by surprise, and it is easier to steer the board.

Another advantage provided by this tongue is a progressive shock absorbing effect of the forward bending movements. This avoids or dampens certain shocks or certain vibrations. The articulation of the ankle is better protected.

BRIEF DESCRIPTION OF DRAWINGS

Other features and advantages of the invention will be better understood from the following description, with reference to the attached schematic drawings showing a non-limiting example of how the invention can be embodied, and in which.

DETAILED DESCRIPTION OF THE INVENTION

An embodiment of the invention, which is described hereinafter with reference to FIGS. 1–4, relates more particularly to a snowboard boot. The invention, however, applies to other fields, such as those mentioned above.

Figure 1:
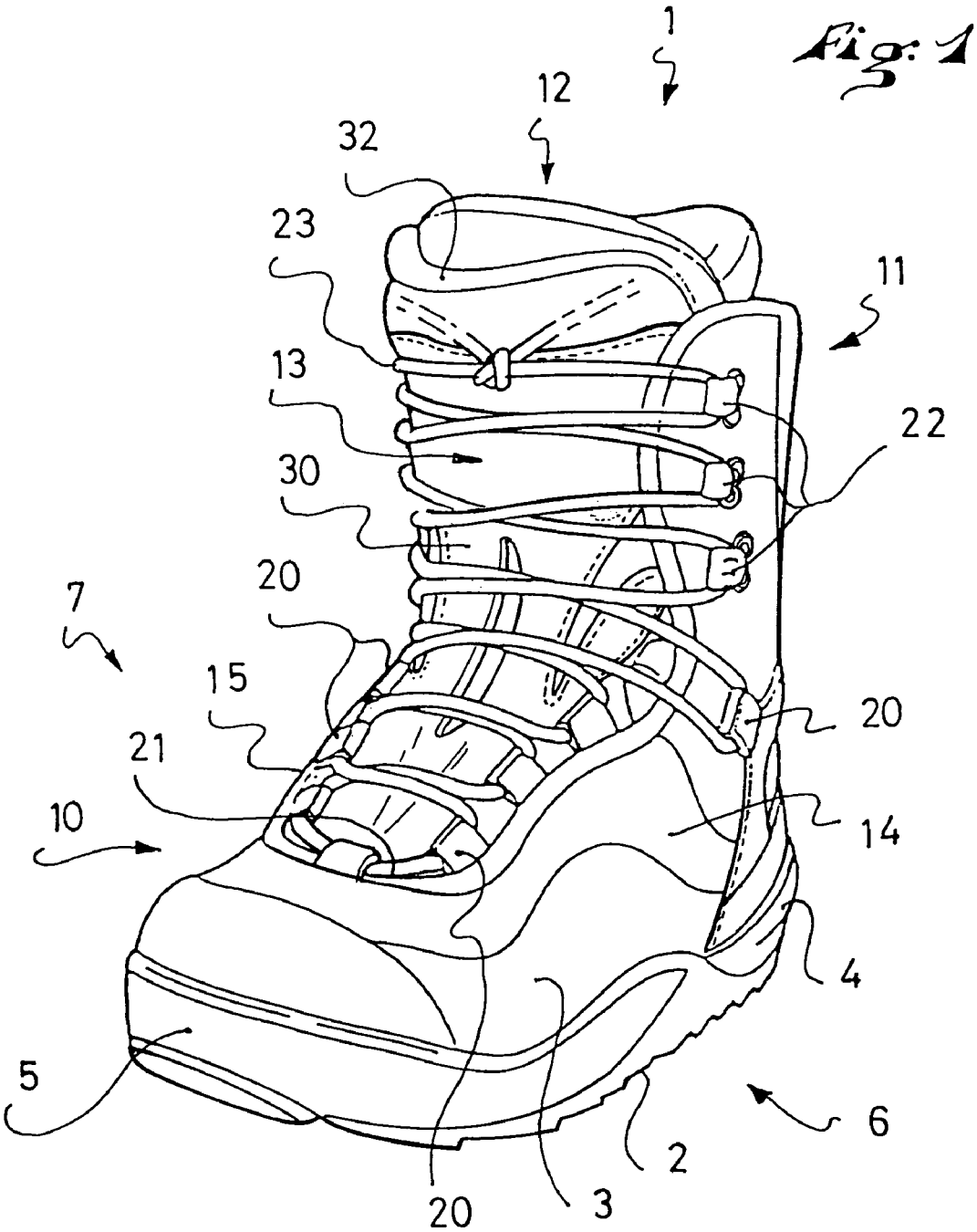
FIG. 1 is a front perspective view of a boot according to an embodiment of the invention.

As shown in FIG. 1, a snowboard boot 1 is provided to receive the user's foot. In a known manner, the boot 1 has a sole 2 and an upper 3. The boot 1 extends lengthwise between a heel 4 and a front end 5, and widthwise between a lateral side 6 and a medial side 7. The upper 3 has a lower portion 10 provided to surround the foot, and an upper portion 11 provided to surround a portion of the lower leg.

The boot 1 is structured to allow a good foot rolling movement when walking, as well as a tilting of the lower leg when steering a board. That is the reason why the sole 2 and the upper 3 are relatively flexible.

An upper opening 12 of the upper 3 is extended forwardly by a longitudinal opening 13, or slit, the longitudinal opening extending between a lateral quarter 14 and a medial quarter 15 of the upper 3. The longitudinal opening 13 allows a relative spacing of the quarters 14, 15 from one another, which makes it easier to put the boot on or take it off.

A tightening means of the type having a lace or the like allows the tightening the upper 3, as well as untightening.

The tightening means, for example, includes low keepers 20, or lace guides, that are spread out over the lateral 14 and medial 15 quarters, and optionally at the base 21 of the longitudinal opening 13.

Each of the low keepers is shown in the form of a loop, made by folding a strap portion, in which a bushing having a low coefficient of friction can be housed. Alternatively, other types of keepers can be used.

The tightening means also has high keepers 22, or lace guides, spread out over the upper portion 11 of the upper 3, on the lateral side 6 and on the medial side 7. The high keepers 22 are shown in the form of hooks.

It is to be understood that other structures could be provided to obtain the low 20 and high 22 keepers.

The tightening means also includes a lace 23 that follows a path set by the keepers 20, 22. For example, the lace 23 alternatively connects a keeper located on the lateral side 6 to a keeper located on the medial side 7, in the lower portion 10 as well as in the upper portion 11 of the upper 3. The lace 23 also traverses the low keeper 20 located at the base 21.

Alternatively, other paths could be envisioned for the lace 23. In any case, a tensioning of the lace 23 allows a tightening of the upper 3, by bringing close together the lateral 14 and medial 15 quarters of the upper 3. Thus, for the boot illustrated in FIG. 1, the lateral and medial quarters of the upper are spaced apart in both the tightened and less tightened or untightened positions of the upper.

Other structures could be provided for the tightening means, such as a series of loops associated with levers on one side of the boot, and hooks for receiving the loops on the other side of the boot.

In order to block the longitudinal opening 13, a tongue 30 extends substantially from the base 21 of the longitudinal opening 13 up to the top of the upper 3.

Figure 2:
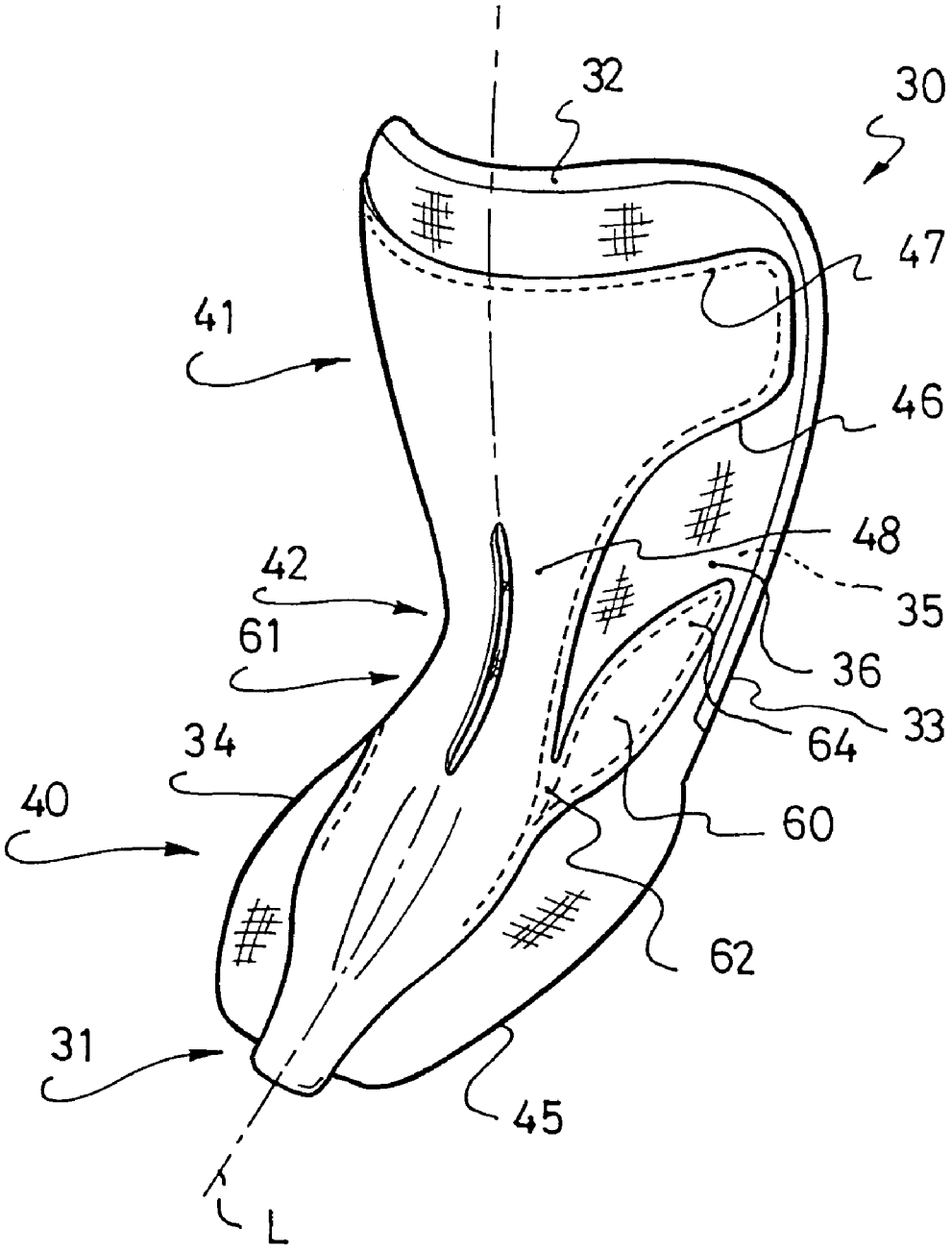
FIG. 2 is a front perspective view of the tongue of the boot of FIG. 1.

As shown in FIG. 2, the tongue 30 extends longitudinally from a lower end 31 to an upper end 32, and transversely from a lateral edge 33 to a medial edge 34.

The tongue 30 has an inner surface 35, turned inwardly toward the upper 3 when it is arranged in the area of the longitudinal opening 13.

Similarly, the tongue 30 has an outer surface 36, turned outwardly of the upper 3 when it is arranged in the area of the longitudinal opening 13.

Between the lower end 31 and the upper end 32, the tongue 30 has a lower portion 40 and an upper portion 41 corresponding to the instep and lower leg, respectively, of the user wearing the boot 1 provided with the tongue 30.

The lower 40 and upper 41 portions are connected by an intermediate portion 42.

The tongue 30 has a main flexible panel 45, the periphery of which is formed by the lower end 31, the lateral edge 33, the upper end 32 and the medial edge 34. The flexible panel 45 is made preferably of one or several layers of non-extensible flexible materials, for instance, fabric, leather, plastic, or the like.

The tongue 30 also has a reinforcement 46 that is affixed to the main panel 45 by a means shown in the form of a stitching 47. The latter is peripheral to the reinforcement 46.

It is to be understood that any other affixing means could be used, such as gluing or welding, or a mounting that is removable by means of pockets or the like.

The reinforcement 46 is preferably arranged over the panel 45, i.e., on the side of the outer surface 36 of the tongue 30. However, it could have been arranged underneath, on the side of the inner surface 35, or integrated into the thickness of the panel 45.

The reinforcement 46 has an elongated body 48 that extends substantially along a longitudinal median line L of the panel 45, and substantially over the length of the panel 45.

The reinforcement 46 is semi-rigid. Preferably, it is constituted of plastic that gives it a rigidity greater than that of the panel 45, but nevertheless allows reversible deformations during a bending of the tongue 30. This bending occurs particularly in the area of the intermediary portion 42 of the tongue 30, as can be appreciated by the FIG. 4 side view of the tongue.

According to the invention, the reinforcement 46 has a lateral extension 60 and a medial extension 61, each extension 60, 61 originating from the elongated body 48 in the area of the lower portion 40 and extending at least partially up to the area of the intermediary portion 42.

It could be provided, of course, that one or both extensions 60, 61 come from the elongated body 48, in the area of the upper portion 41 of the tongue 30. Furthermore, a single extension 60, 61 could be provided.

Figure 3:
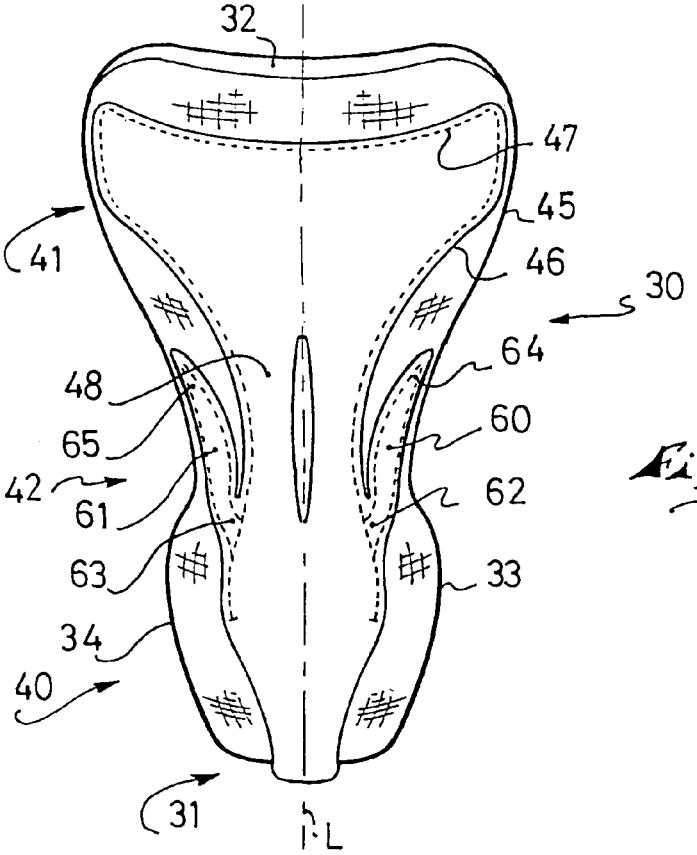
FIG. 3 is a front view of the tongue.

As seen better in FIG. 3, the reinforcement 46 is preferably symmetrical with respect to the median line L, but it could also be asymmetrical depending on the desired effects.

The extensions 60, 61 are connected to the body 48 at their respective bases 62, 63, in the same area in the lower portion 40.

Figure 4:
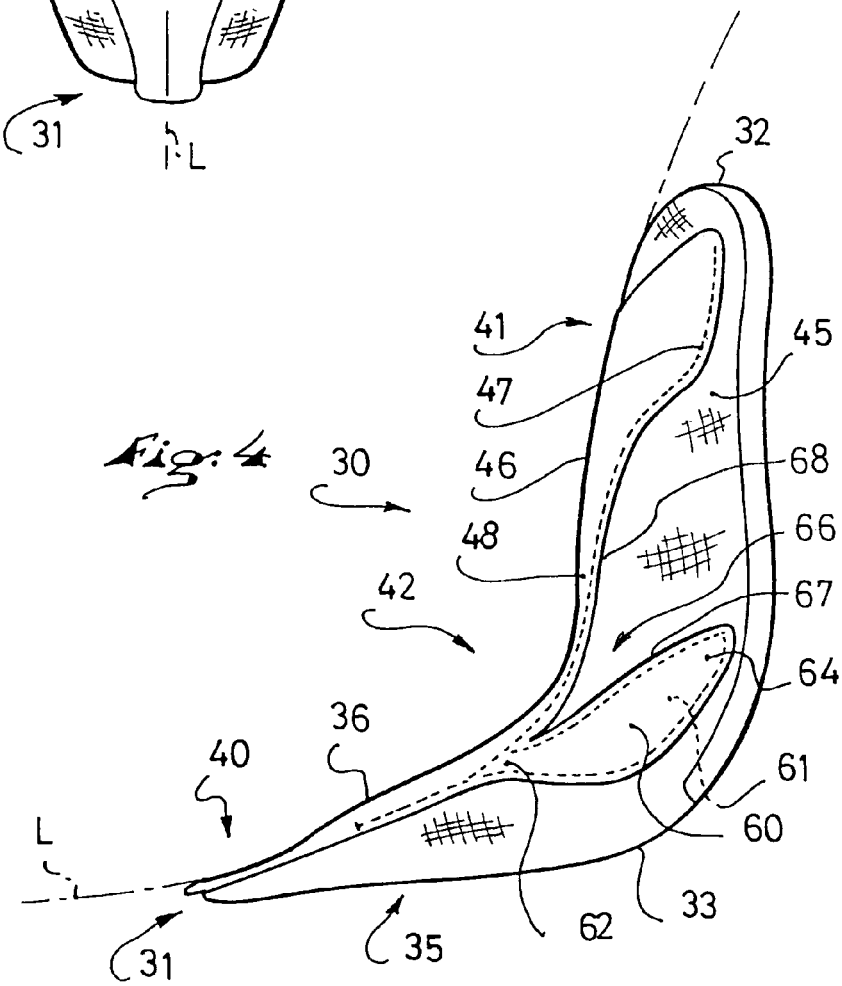
FIG. 4 is a side view of the tongue.

In this same context, the respective ends 64, 65 of the extensions are located at the same longitudinal level, in the area of the intermediary portion 42. In FIGS. 1 and 4 it can be seen that, in the non-limiting illustrated embodiment, the extensions 60, 61 extend rearwardly and upwardly from the elongated body 48 of the reinforcement. Also, FIGS. 3 and 4, e.g., show that the reinforcement, in the illustrated embodiment, is contained within, i.e., spaced from, the outer periphery of the tongue 30.

Each extension 60, 61 extends along the panel 45, both toward the upper end 32 and toward the lateral 33 or medial 34 edge, respectively, of the tongue 30. Each extension 60, 61 lengthens the body 48 of the reinforcement 46 much like the wings lengthen the body of a swallow. In the non-limiting illustrated embodiment, each of the extensions 60, 61 has an elongated shape widened between a respective connected end or base 62, 63 and a respective free end 64, 65.

As shown in FIG. 4, a slit 66 is formed between an inner edge 67 of the extension 60 and an outer edge 68 of the body 48 of the reinforcement 46. Of course, in the illustrated embodiment, shown in FIG. 3, a slit is also formed between the medial extension 61 and the body of the reinforcement. In the illustrated embodiment, the slits are shown as tapering toward an inner end and widening in the direction of the free ends 64, 65 of the extensions.

As is also shown in FIG. 4, the tongue 30 is concave in a transverse plane, in the area of the intermediary portion 42, on the side of the inner surface 35. Naturally, the transverse plane is substantially perpendicular to the median line L.

The structure of the tongue is such that the lateral 60 and medial 61 extensions are each substantially located at the base of the concave portion of the intermediary portion 42, and the elongated body 48 passes through the apex of this concave portion. In addition, in the particular embodiment illustrated, FIG. 4 shows the extensions 60, 61 to extend rearwardly and upwardly to the area of the apex of the concave portion of the elongated body 48.

The tongue 30 is also concave in a longitudinal plane, in the area of the intermediary portion 42, on the side of the outer surface 36. This structure of the tongue 30 allows it to conform to the shapes of the user's instep and front part of the lower leg.

When the user bends the lower leg forwardly, the upper 3 tends to bend forwardly. As a consequence, the upper end 32 of the tongue tends to come closer to the lower end 31.

When the tightening means maintains the upper 3 closed and tight, the lateral 14 and medial 15 quarters of the upper 3 press on the lateral 60 and medial 61 extensions of the reinforcement 46.

Since the semi-rigid extensions 60, 61 are affixed to the flexible panel 45, they naturally put the latter under a slight tension.

Consequently, a forward bending force exerted on the tongue 30 increases the tension of the portions of the flexible panel 45 that are between an extension 60, 61 and the upper end 32. Since the panel 45 is substantially inextensible, the greater the forward bending force, the more the flexible panel 45 is tensioned. In a forward bending, the rigidity of the tongue 30 is therefore proportional to the bending force.

The reaction exerted by the tongue 30 on the lower leg will therefore vary progressively.

This is true to a certain limit depending on the physical characteristics of the tongue.

Thus the user can better anticipate the behavior of the board. Additionally, the tongue 30 promotes shock absorption.

When the tightening means no longer tightens the upper 3, or is loosened, the rigidity of the tongue 30 is reduced.

The user can adjust the rigidity of the tongue 30 and consequently of the upper 3 by adjusting the tightening of the upper. This enables him or her, for example, to adapt the boot to a type of steering.

Generally speaking, the invention is embodied with materials and according to implementing techniques that are known to those skilled in the art.

The invention is not limited to the example described hereinabove, and includes all technical equivalents that fall within the scope of the following claims.

Specifically, numerous forms can be given to the lateral 60 and medial 61 extensions, such as that of an elongated tree leaf, a flat ruler, or the like.

The body of the tongue reinforcement can be of a variable length and of a variable thickness.

The reinforcement can have a plurality of lateral and medial extensions.

The reinforcement is not necessarily symmetrical along a longitudinal median line.

What is claimed is:

1. A boot comprising:

a sole;

a high upper, the upper having an upper opening extended forwardly by a longitudinal opening;

a tongue blocking the longitudinal opening, the tongue having a lower portion adapted to extend over a wearer's instep and an upper portion adapted to extend along a wearer's lower leg, the lower and upper portions of the tongue being connected by an intermediary portion, the intermediary portion including a concavity in a longitudinal plane of the tongue;

the tongue having a main flexible panel, a semi-rigid reinforcement being affixed to the main flexible panel, the reinforcement having an elongated body extending substantially along a longitudinal median line and over a length of the panel, the reinforcement having at least one extension, at least said one extension originating from the elongated body in an area of the lower portion or the upper portion of the tongue, and extending rearwardly of the instep and at least within the intermediary portion;

a slit is formed between an inner edge of at least said one extension and an outer edge of the elongated body of the reinforcement.

2. A boot according to claim 1, wherein:

the upper is a flexible upper.

3. A boot according to claim 2, wherein:

each said extension originates from the elongated body in an area of the lower portion of the tongue.

4. A boot according to claim 3, wherein:

each said extension extends along the length of the panel, both towards an upper end and towards a lateral or medial edge, respectively, of the tongue.

5. A boot according to claim 2, wherein:

the reinforcement is substantially symmetrical with respect to the longitudinal median line.

6. A boot according to claim 2, wherein:

each said extension has an elongated shape, said elongated shape tapering toward each of two opposite ends.

7. A boot according to claim 2, wherein:

the reinforcement is arranged on the side of the outer surface of the tongue.

8. A boot according to claim 2, wherein:

the reinforcement is affixed to the panel by stitching.

9. A boot according to claim 2, wherein:

the flexible panel has at least one layer of inextensible fabric, and wherein the reinforcement is made from plastic.

10. A boot according to claim 1, wherein:

the boot is a snowboard boot, the upper comprising a flexible material for facilitating flexing of the upper during use.

11. A boot according to claim 1, wherein:

at least said one extension extends from the area of the lower portion or upper portion of the elongated body of the reinforcement and extends rearwardly and upwardly to a height of an apex of the concavity of the intermediary portion.

12. A tongue for a boot, said tongue comprising:

a lower portion and an upper portion corresponding to an instep and lower leg, respectively, of a user wearing a boot provided with the tongue, the lower and upper portions being joined by an intermediary portion, the intermediary portion including a concavity in a longitudinal plane of the tongue;

a main flexible panel and a semi-rigid reinforcement affixed to the main flexible panel, the reinforcement having an elongated body extending substantially along the longitudinal median plane and over a length of the panel, the reinforcement having at least one extension, at least said one extension originating from the elongated body in an area of the lower portion or the upper portion of the tongue and extending rearwardly of the instep and at least within the intermediary portion;

a slit is formed between an inner edge of at least said one extension and an outer edge of the elongated body of the reinforcement.

13. A tongue according to claim 12, wherein:

each said extension has an elongated shape, said elongated shape tapering toward each of two opposite ends.

14. A tongue according to claim 12, wherein:

the reinforcement is arranged on the side of the outer surface of the tongue.

15. A tongue according to claim 12, wherein:

the reinforcement is affixed to the panel by stitching.

16. A tongue according to claim 12, wherein:

the flexible panel has at least one layer of inextensible fabric, and wherein the reinforcement is made from plastic.

17. A tongue according to claim 12, wherein:

at least said one extension extends from the area of the lower portion or upper portion of the elongated body of the reinforcement and extends rearwardly and upwardly to a height of an apex of the concavity of the intermediary portion.

18. A reinforcement for a tongue of a boot, said reinforcement comprising:

a lower portion and an upper portion corresponding to an instep and lower leg, respectively, of a user wearing a boot provided with the tongue, the lower and upper portions being joined by an intermediary portion, the intermediary portion including a concavity in a longitudinal plane of the reinforcement;

the reinforcement being semi-rigid and having an elongated body extending substantially along the longitudinal median plane, the reinforcement having at least one extension, at least said one extension originating from the elongated body in an area of the lower portion or upper portion, and extending at least within the intermediary portion;

a slit is formed between an inner edge of at least said one extension and an outer edge of the elongated body of the reinforcement.

19. A reinforcement according to claim 18, wherein:

each said extension has an elongated shape, said elongated shape tapering toward each of two opposite ends.

20. A reinforcement according to claim 18, wherein:

the reinforcement is made from plastic.

21. A reinforcement according to claim 18, wherein:

at least said one extension extends from the area of the lower portion or upper portion of the elongated body of the reinforcement and extends rearwardly and upwardly to a height of an apex of the concavity of the intermediary portion.

22. A boot comprising:

a sole;

an upper mounted upon said sole, said upper comprising a lower portion adapted to receive a wearer's foot and an upper portion adapted to extend above the wearer's ankle and adapted to receive a portion of the wearer's lower leg;

each of said lower and upper portions of said upper including medial and lateral sides;

said medial and lateral sides of both said lower and upper portions of said upper being outermost boot surfaces laterally spaced apart to define a longitudinally extending opening;

a tongue positioned within said opening;

said tongue comprising:

a main panel extending transversely from said medial sides to said lateral sides of both said lower and upper portions of said upper, said main panel further comprising an intermediary portion positioned longitudinally between the lower and upper portions of said upper;

a rigidifying reinforcement affixed to said main panel;

said reinforcement comprising:

an elongated body extending along said main panel;

at least one extension extending along said main panel from said elongated body of said reinforcement in either the lower portion or the upper portion of the upper to a free end, said extension extending rearwardly of the instep and at least within said intermediary portion;

a tightening arrangement for bringing said medial and lateral sides towards each other to tighten said upper upon the foot and lower leg of the wearer.

23. A boot according to claim 22, wherein:

said intermediary portion of said main panel has a concavity extending along a longitudinal median plane of the tongue; and said extension extending at least to a height of an apex of said concavity.

24. A boot according to claim 22, wherein:

said medial and lateral sides are spaced apart in both tightened and non-tightened positions of said upper.

25. A boot comprising:

a sole;

an upper mounted upon said sole, said upper comprising a lower portion adapted to receive a wearer's foot and an upper portion adapted to extend above the wearer's ankle and adapted to receive a portion of the wearer's lower leg;

each of said lower and upper portions of said upper including medial and lateral sides;

said medial and lateral sides of both said lower and upper portions of said upper being outermost boot surfaces laterally spaced apart to define a longitudinally extending opening;

a tongue positioned within said opening;

said tongue comprising:

a main panel extending from said medial sides to said lateral sides of both said lower and upper portions of said upper, said main panel further comprising an intermediary portion between the lower and upper portions of said upper;

a reinforcement affixed to said main panel, said reinforcement being more rigid than said main panel;

said reinforcement comprising:

an elongated body extending along said main panel;

at least one extension extending along said main panel from said elongated body of said reinforcement in either the lower portion or the upper portion of the upper to a free end, said extension extending at least within said intermediary portion;

at least said one extension of said reinforcement having an elongated shape, said elongated shape including a free end and a connected end connected to said elongated body of said reinforcement, at least said one extension having a widest extent between said free end and said connected end;

a tightening arrangement for bringing said medial and lateral sides towards each other to tighten said upper upon the foot and lower leg of the wearer.

26. A boot according to claim 22, wherein:

said tightening arrangement comprises:

a plurality of lace guides attached to said medial and lateral sides of said lower portion of said upper;

a plurality of lace guides attached to said medial and lateral sides of said upper portion of said upper;

a lace guided by at least a plurality of said pluralities of lace guides.

27. A boot according to claim 22, wherein:

the boot is a snowboard boot; and said upper is relatively flexible to allow a rolling movement of the foot of the wearer during walking when the boot is detached from a snowboard and said upper is tightened upon the foot and lower leg of the wearer, and to allow a tilting of the lower leg of the wearer when the boot is attached to a snowboard and said upper is tightened upon the foot and lower leg of the wearer.

28. A boot according to claim 22, wherein:

said reinforcement comprises means for progressively rigidifying said main panel in proportion to an amount of forward bending force applied by the lower leg of the wearer to said tongue in said tightened position of said upper.

29. A boot according to claim 22, wherein:

said main panel of said tongue comprises a lower portion adapted to lie over an instep of the foot of the wearer and an upper portion adapted to lie over the lower leg of the wearer, said lower and upper portions of said main panel of said tongue being made of the same material.

30. A boot according to claim 22, wherein:

said main panel of said tongue comprises a lower portion adapted to lie over an instep of the foot of the wearer and an upper portion adapted to lie over the lower leg of the wearer, said lower and upper portions of said main panel of said tongue are unitary.

31. A boot according to claim 22, wherein:

said at least one extension Comprises two extensions, said two extensions extending from respective opposite sides of said elongated body.

32. A boot according to claim 22, wherein:

said at least one extension is spaced inwardly toward the longitudinal median plane of the tongue from an outer periphery of the main panel of the tongue.

33. A boot according to claim 22, wherein:

said sole is a flexible sole allowing a rolling movement of the foot when walking.

34. A boot according to claim 22, wherein:

a slit is formed between an inner edge of at least said one extension and an outer edge of the elongated body of the reinforcement.

35. A boot according to claim 1, wherein:

said at least one extension extends at least within said concavity of said intermediary portion.

36. A boot according to claim 35, wherein:

said concavity of said intermediary portion of said tongue comprises a bending zone of said tongue;

said at least one extension extends at least within said bending zone.

37. A boot according to claim 1, wherein:

said reinforcement extends from within said lower portion to within said upper portion.

38. A boot according to claim 12, wherein:

said at least one extension extends at least within said concavity of said intermediary portion.

39. A boot according to claim 38, wherein:

said concavity of said intermediary portion of said tongue comprises a bending zone of said tongue;

said at least one extension extends at least within said bending zone.

40. A boot according to claim 12, wherein:

said reinforcement extends from within said lower portion to within said upper portion.

41. A boot according to claim 18, wherein:

said at least one extension extends at least within said concavity of said intermediary portion.

42. A boot according to claim 41, wherein:

said at least one extension extends at least within said concavity of said intermediary portion;

said concavity of said intermediary portion of said tongue comprises a bending zone of said tongue.

43. A boot according to claim 22, wherein:

said elongated body of said reinforcement extends from within said lower portion to within said upper portion.

44. A boot comprising:

a sole;

an upper comprising:

a lower portion adapted to extend above a part of an instep of a foot of a wearer of the boot;

an upper portion adapted to extend around a part of a lower leg of the wearer;

a medial quarter comprising a medial part of the lower portion and a medial part of the upper portion;

a lateral quarter comprising a lateral part of the lower portion and a lateral part of the upper portion;

a longitudinal opening extending between the medial and lateral quarters from within said lower portion through said upper portion, said longitudinal opening being connected to an upper opening of the boot;

a tongue comprising a main panel and at least one reinforcement affixed to said main panel;

said main panel of said tongue extending transversely from beneath said medial quarter of the upper to beneath said lateral quarter of said upper and extending longitudinally from within said lower portion of said upper to within said upper portion of said upper;

said main panel of said tongue further comprising:

an instep portion adapted to be positioned above the instep of the wearer;

a lower leg portion adapted to be positioned forwardly of the lower leg of the wearer;

a bending zone extending from a rearwardmost end of the instep portion of the tongue to a lowermost end of the lower leg portion of the tongue, said bending zone comprising an upwardly facing longitudinally extending concavity;

said reinforcement of said tongue further comprising an elongated body, said elongated body extending within said instep portion of said main panel and extending to within said lower leg portion of said main panel, said reinforcement of said tongue further comprising at least one extension having a length and width;

said extension connected to said elongated body of said reinforcement at either (a) said instep portion of said main panel of said tongue or (b) said lower leg portion of said main panel of said tongue;

said extension extending away from said elongated body lengthwise of the extension to within at least said bending zone of said main panel of said tongue.

45. A boot according to claim 44, wherein:

said at least one extension of said reinforcement of said tongue comprises said extension, said extension extending away lengthwise from a medial side of said elongated body of said reinforcement;

said at least one extension of said reinforcement of said tongue further comprises a second extension, said second extension extending away lengthwise from a lateral side of said elongated body of said reinforcement.

* * * * *